US010982663B2

(12) United States Patent
Suzuki et al.

(10) Patent No.: US 10,982,663 B2
(45) Date of Patent: Apr. 20, 2021

(54) VACUUM PUMP

(71) Applicant: ULVAC, INC., Chigasaki (JP)

(72) Inventors: Toshio Suzuki, Chigasaki (JP); Tomonari Tanaka, Chigasaki (JP); Kenji Hashimoto, Chigasaki (JP)

(73) Assignee: ULVAC, INC., Chigasaki (JP)

( * ) Notice: Subject to any disclaimer, the term of this patent is extended or adjusted under 35 U.S.C. 154(b) by 0 days.

(21) Appl. No.: 16/617,984

(22) PCT Filed: Mar. 14, 2018

(86) PCT No.: PCT/JP2018/009972
§ 371 (c)(1),
(2) Date: Nov. 27, 2019

(87) PCT Pub. No.: WO2018/220943
PCT Pub. Date: Dec. 6, 2018

(65) Prior Publication Data

US 2020/0109705 A1 Apr. 9, 2020

(30) Foreign Application Priority Data

May 30, 2017 (JP) ..... JP2017-106353

(51) Int. Cl.
*F04B 39/00* (2006.01)
*F04B 37/14* (2006.01)
*F04C 29/06* (2006.01)

(52) U.S. Cl.
CPC ..... *F04B 39/0027* (2013.01); *F04B 37/14* (2013.01); *F04B 39/0061* (2013.01); *F04C 29/06* (2013.01)

(58) Field of Classification Search
CPC .... F04C 25/02; F04C 18/126; F04C 2220/10; F04C 18/3441; F04C 2240/30;
(Continued)

(56) References Cited

U.S. PATENT DOCUMENTS 4,676,065 A * 6/1987 Eberhardt ..... F02B 75/007 60/310
5,107,953 A * 4/1992 Shimizu ..... C08G 63/605 181/255
(Continued)

FOREIGN PATENT DOCUMENTS

JP 59-35692 U 3/1984
JP 63-83425 A 4/1988
(Continued)

OTHER PUBLICATIONS

International Search Report in International Application No. PCT/JP2018/009972, filed Mar. 14, 2018.
(Continued)

*Primary Examiner* — Dominick L Plakkoottam
(74) *Attorney, Agent, or Firm* — Saliwanchik, Lloyd & Eisenschenk

(57) ABSTRACT

A vacuum pump includes a pump main body and a sound muffling device. The pump main body includes a housing including an intake port and an exhaust port, and a rotor that is rotatably arranged inside the housing and transports gas from the intake port to the exhaust port. The sound muffling device includes a casing, a first passage portion, and a second passage portion. The casing includes an opening end portion that is airtightly connected to an outer wall surface of the housing, a bottom wall portion that faces the opening end portion, and a peripheral wall portion, the casing defining an expansion chamber by the outer wall surface of the housing and respective inner wall surfaces of the bottom wall portion and the peripheral wall portion.

6 Claims, 5 Drawing Sheets

(58) Field of Classification Search
CPC .... F04C 29/061; F04C 29/063; F04C 29/068; F04C 18/123; F04C 18/16; F04C 29/06; B60T 13/52; F01C 21/10; F04B 37/14; F04B 39/0027; F04B 39/0061
See application file for complete search history.

(56) References Cited

U.S. PATENT DOCUMENTS

| | | | | |
|---|---|---|---|---|
| 5,208,429 | A * | 5/1993 | Field | F02M 35/1222 181/229 |
| 5,723,827 | A * | 3/1998 | Sasaki | F01N 1/02 181/237 |
| 9,657,732 | B2 * | 5/2017 | Lucas | F04B 39/0027 |
| 9,709,057 | B2 * | 7/2017 | Mitsuhashi | F04C 29/063 |
| 2003/0180153 | A1 * | 9/2003 | Yamamoto | F04C 25/02 417/53 |
| 2004/0131472 | A1 * | 7/2004 | Yamamoto | F04C 23/001 417/199.1 |
| 2006/0039803 | A1 | 2/2006 | Nakano et al. | |
| 2010/0150760 | A1 * | 6/2010 | Yamamoto | F04C 18/126 418/9 |
| 2010/0310389 | A1 * | 12/2010 | Alvarenga | F04B 39/0055 417/312 |
| 2016/0369820 | A1 * | 12/2016 | Neel | F04F 5/461 |
| 2017/0284398 | A1 * | 10/2017 | Mitsuhashi | F04C 25/02 |
| 2018/0347555 | A1 * | 12/2018 | De Bortoli | F04B 39/0072 |

FOREIGN PATENT DOCUMENTS

| | | | |
|---|---|---|---|
| JP | 8-135586 | A | 5/1996 |
| JP | 4-47183 | A | 2/1998 |
| JP | 2010-138725 | A | 6/2010 |
| JP | 2013-113232 | A | 6/2013 |

OTHER PUBLICATIONS

Office Action dated Sep. 7, 2020 in German Application No. 11 2018 002 764.3, along with its English translation.

* cited by examiner

VACUUM PUMP

CROSS-REFERENCE TO RELATED APPLICATIONS

This application is the U.S. national stage application of International Patent Application No. PCT/JP2018/009972, filed Mar. 14, 2018, which claims the benefit under 35 U.S.C. § 119 of Japanese Application No. 2017-106353, filed May 30, 2017, the disclosures of each of which are incorporated herein by reference in their entirety.

TECHNICAL FIELD

The present invention relates to a positive displacement type vacuum pump including a sound absorbing device.

BACKGROUND ART

A two-spindle screw pump, for example, is known as a positive displacement type dry vacuum pump. The screw pump of this type includes a housing including an intake port and a discharge port and a pair of screw rotors housed in the housing. The screw pump of this type is configured to rotate the pair of screw rotors to thereby transport gas from the intake port to the discharge port.

Further, as the vacuum pump of this type, there is known one including a sound muffling device (silencer) in an exhaust port. For example, in Patent Literature 1, there has disclosed a vacuum pump apparatus in which an exhaust manifold including a common muffler chamber is connected to an exhaust port of each of first to third booster pumps.

CITATION LIST

Patent Literature

Patent Literature 1: Japanese Patent Application Laid-open No. 2010-138725

DISCLOSURE OF INVENTION

Technical Problem

In recent years, it is desirable to downsize a conventional vacuum pump including the sound muffling device. However, it is necessary to secure a cross-sectional area having a predetermined size or more in a space through which discharged gas passes for obtaining a sound muffling function. Therefore, only downsizing the sound muffling device cannot provide a desired sound muffling effect.

In view of the above-mentioned circumstances, it is an object of the present invention to provide a vacuum pump capable of securing a sound muffling effect and achieving downsizing.

Solution to Problem

In order to accomplish the above-mentioned object, a vacuum pump according to an embodiment of the present invention includes a pump main body and a sound muffling device.

The pump main body includes a housing and a rotor. The housing includes an intake port and an exhaust port. The rotor is rotatably arranged inside the housing and transports gas from the intake port to the exhaust port.

The sound muffling device includes a casing, a first passage portion, and a second passage portion. The casing includes an opening end portion that is airtightly connected to an outer wall surface of the housing, a bottom wall portion that faces the opening end portion, and a peripheral wall portion, the casing defining an expansion chamber by the outer wall surface of the housing and respective inner wall surfaces of the bottom wall portion and the peripheral wall portion. The first passage portion is provided in the casing and introduces gas into the expansion chamber, the gas being discharged from the exhaust port. The second passage portion is provided in the casing and discharges the gas inside the expansion chamber outside the casing.

In the vacuum pump, the sound muffling device causes the gas discharged from the exhaust port to pass through the first passage portion, the expansion chamber, and the second passage portion to be discharged, to thereby reduce pump exhaust sound at a predetermined level or less.

In the sound muffling device, the casing includes the opening end portion and is connected to an outer wall surface of the pump main body via the opening end portion. Therefore, the capacity of the expansion chamber can be secured and the sound muffling device can be mounted on the pump main body in a compact state. With this configuration, the sound muffling effect can be secured and the vacuum pump can be downsized.

The sound muffling device may further include a valve member capable of opening and closing the exhaust port, and a valve chamber that is provided between the exhaust port and the expansion chamber and houses the valve member.

With this configuration, counter flow of gas from the side of the sound muffling device to the inside of the pump main body can be inhibited.

The peripheral wall portion may include a first side wall portion that defines the expansion chamber and the valve chamber, and a second side wall portion that faces the first side wall portion in one axis direction. In this case, the first passage portion penetrates the first side wall portion and is constituted by a first pipe member that extends from the first side wall portion toward an inside of the expansion chamber in the one axis direction, and the second passage portion penetrates the second side wall portion and is constituted by a second pipe member that extends from the second side wall portion toward the inside of the expansion chamber in the one axis direction.

With this configuration, the capacity of the expansion chamber can be secured and a rapidly enlarged portion and a rapidly reduced portion of the flow channel cross-section can be formed. Therefore, sound muffling effect in a low-frequency band can be improved.

In this case, the first and second pipe members may have respective shaft centers that are arranged at positions offset from each other and include regions that face each other in an axis direction orthogonal to the one axis direction.

With this configuration, a further improvement in the sound muffling effect can be achieved.

The sound muffling device may be arranged on a bottom portion of the pump main body, and the casing may further include a water drain portion including a water drain port.

With this configuration, it is easy to discharge liquid such as condensed water and dew condensation water inside the expansion chamber.

The water drain portion may further include a guide passage provided in the bottom wall portion and is tilted toward the water drain port.

The vacuum pump may further include a plurality of leg portions. The plurality of leg portions are provided in the bottom portion of the pump main body and support the pump main body. In this case, the sound muffling device may be arranged between the plurality of leg portions.

With this configuration, the vacuum pump can be made compact.

Advantageous Effects of Invention

As described above, in accordance with the present invention, it is possible to secure a sound muffling effect and achieve downsizing of a vacuum pump.

MODE(S) FOR CARRYING OUT THE INVENTION

Hereinafter, embodiments of the present invention will be described with reference to the drawings.

First Embodiment

Figure 1:
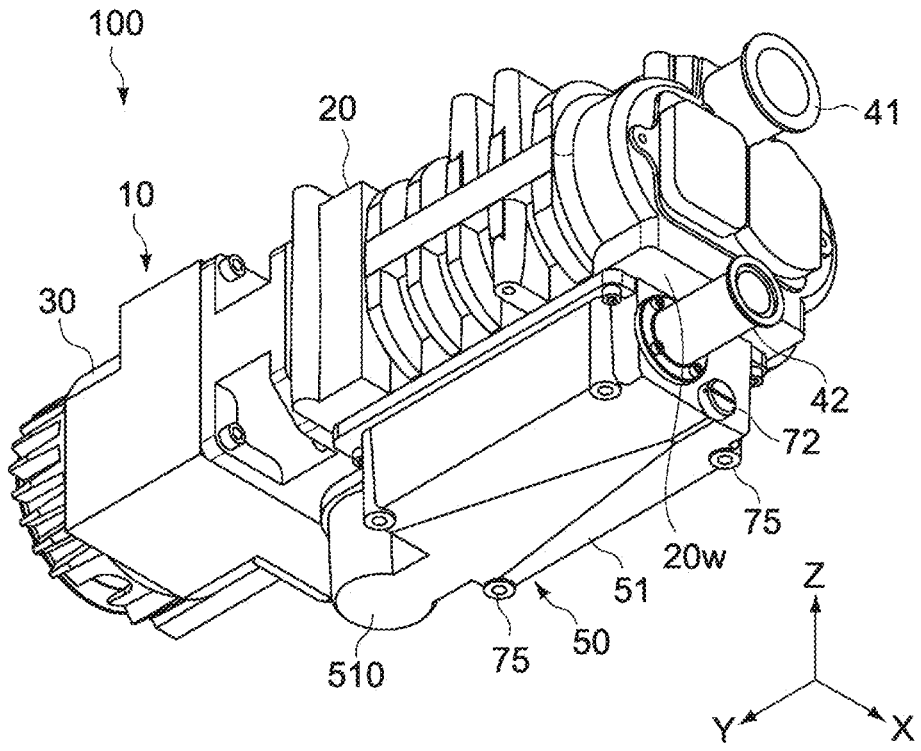
FIG. 1 A perspective view of a bottom of a vacuum pump according to a first embodiment of the present invention.
Figure 2:
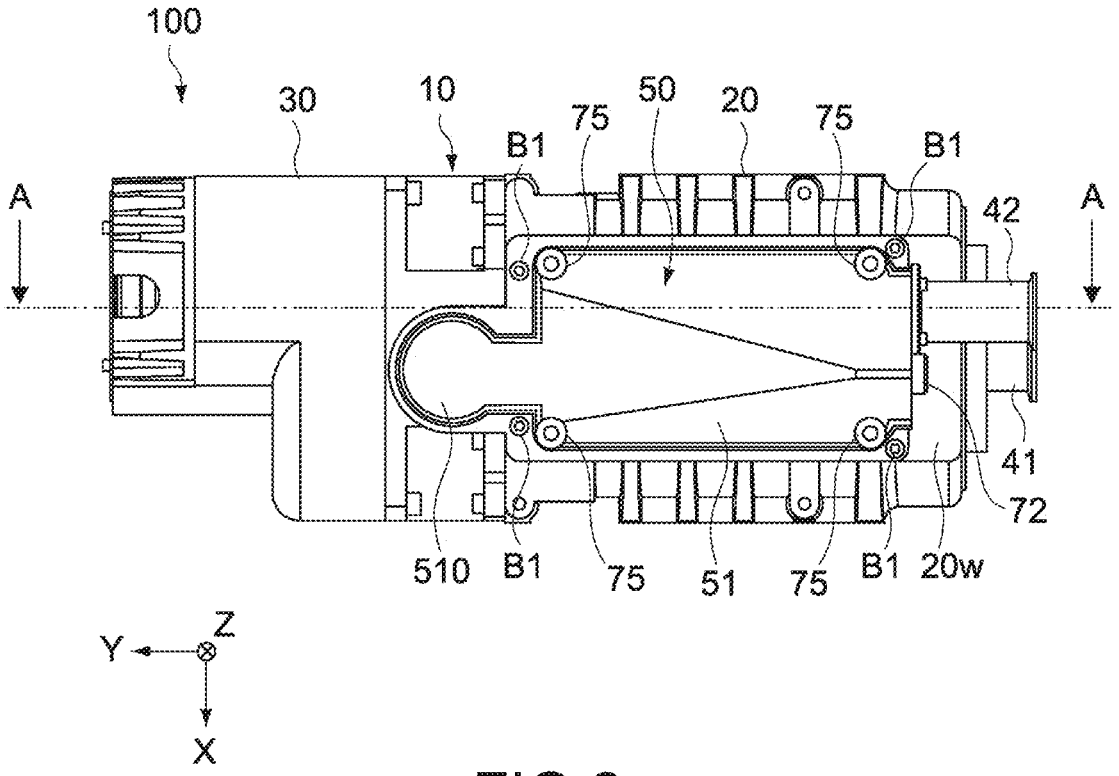
FIG. 2 A bottom view of the vacuum pump.
Figure 3:
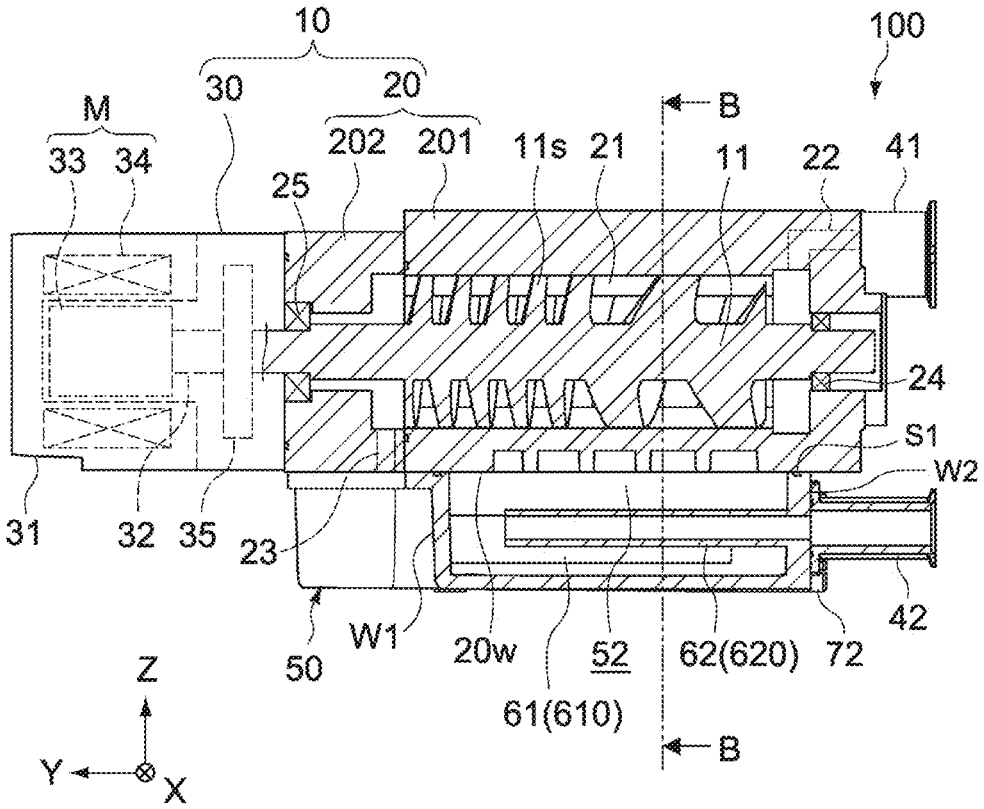
FIG. 3 A cross-sectional view taken along the line A-A of FIG. 2.
Figure 4:
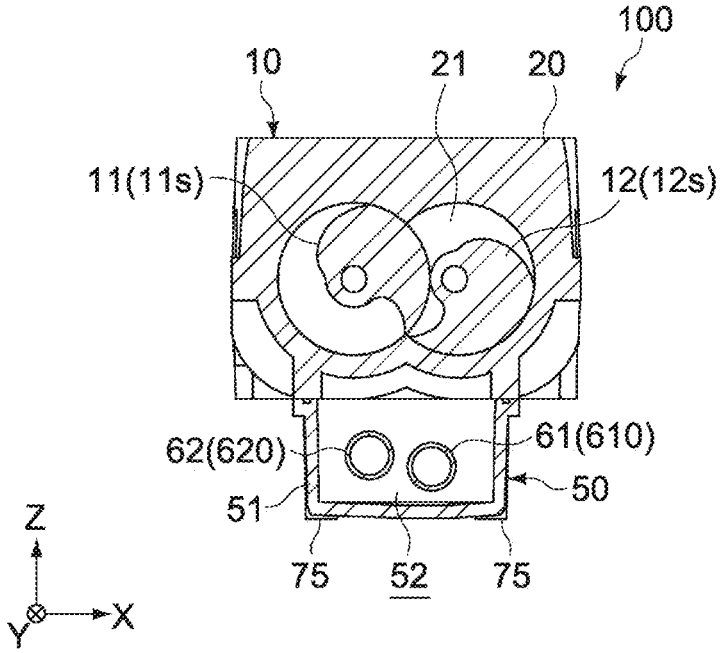
FIG. 4 A cross-sectional view taken along the line B-B of FIG. 3.

FIG. 1 is a perspective view of a bottom of a vacuum pump according to an embodiment of the present invention. FIG. 2 is a bottom view thereof. FIG. 3 is a cross-sectional view taken along the line A-A of FIG. 2. FIG. 4 is a cross-sectional view taken along the line B-B of FIG. 3.

It should be noted that in each figure, the X-axis, the Y-axis, and the Z-axis denote three axis directions orthogonal to one another and the Z-axis corresponds to a height direction.

A vacuum pump 100 according to this embodiment is constituted by a screw pump. The vacuum pump 100 includes a pump main body 10 and a sound muffling device 50.

[Pump Main Body]

The pump main body 10 includes a first screw rotor 11, a second screw rotor 12, a housing 20, and a drive unit 30.

As shown in FIGS. 3 and 4, the first and second screw rotors 11 and 12 each include a shaft center parallel to the Y-axis direction and are arranged in a rotor chamber 21 inside the housing 20 in such a manner that the first and second screw rotors 11 and 12 are adjacent to each other in the X-axis direction. The first screw rotor 11 includes helical teeth 11*s*. The second screw rotor 12 includes helical teeth 12*s* that mesh with the teeth 11*s*. The first and second screw rotors 11 and 12 are each constituted by a single threaded screw including two lead portions. The two lead portions are an unequal lead portion and an equal lead portion.

The teeth 11*s* and 12*s* each have a substantially identical shape except for the fact that the helical directions are opposite to each other. The teeth 11*s* and 12*s* mesh with each other having a slight clearance such that one teeth are positioned between the other teeth (grooves). Outer circumferential surfaces of the teeth 11*s* face an inner wall surface of the rotor chamber 21 and an outer circumferential surface of a shaft portion of the second screw rotor 12 (bottom portions of grooves between the teeth 12*s*), having a slight clearance therebetween. On the other hand, outer circumferential surfaces of the teeth 12*s* face the inner wall surface of the rotor chamber 21 and an outer circumferential surface of the shaft portion of the first screw rotor 11 (bottom portions of grooves between the teeth 11*s*), having a slight clearance therebetween.

The housing 20 is made of metal material. The housing 20 includes a first housing portion 201 and a second housing portion 202. The first housing portion 201 includes the rotor chamber 21 and an intake port 22. The second housing portion 202 includes an exhaust port 23. The second housing portion 202 is coupled between the first housing portion 201 and a motor casing 31 of the drive unit 30 via a seal ring.

The intake port 22 and the exhaust port 23 communicate with each other via the rotor chamber 21. The intake port 22 is provided on an intake end side of the first and second screw rotors 11 and 12 and the exhaust port 23 is provided on an exhaust end side thereof. An intake pipe 41 communicating with a vacuum chamber (not shown) is connected to the intake port 22. The sound muffling device 50 to be described later is connected to the exhaust port 23. The first and second screw rotors 11 and 12 are arranged to be rotatable in the rotor chamber 21 via bearings 24, 25 mounted on intake end side and exhaust end thereof.

The positions of the intake port 22 and the exhaust port 23 are not limited to the above-mentioned example and can be changed as appropriate. For example, the intake port 22 may be formed toward the second housing portion 202 or the exhaust port 23 may be provided in the first housing portion 201. The housing 20 is also not limited to the example in which it is configured by combining the first and second housing portions 201 and 202. The housing 20 may be constituted by a single housing component. The housing 20 may be constituted by a combination of three or more housing components.

As shown in FIG. 3, the drive unit 30 includes a motor M that rotates the first and second screw rotors 11 and 12. The motor M is constituted by a motor rotor 33 and a motor stator 34. The motor rotor 33 is mounted on a shaft portion 32 on an exhaust end side of the first screw rotor 11. The motor stator 34 is provided around the motor rotor 33 in such a manner that the motor stator 34 faces the motor rotor 33, spaced apart from the motor rotor 33. The motor casing 31 is airtightly connected to the second housing portion 202 and retains the motor stator 34 therein.

A synchronization gear 35 is mounted on the shaft portion 32. The synchronization gear 35 meshes with a synchronization gear (not shown) mounted on an exhaust-end-side shaft portion of the second screw rotor 12. Rotational driving force of the motor M to the first screw rotor 11 is transferred to the second screw rotor 12 via the synchronization gear 35. The motor M rotates the first and second screw rotors 11 and 12 in such a manner that gas inside the vacuum chamber, which is taken in through the intake port 22, is transported toward the exhaust port 23.

[Sound Muffling Device]

The sound muffling device 50 is arranged on a bottom portion of the pump main body 10. The sound muffling device 50 is for reducing exhaust sound of gas which is taken in by the pump main body 10 and exhausted from the exhaust port 23. Hereinafter, the sound muffling device 50 will be described in detail.

Figure 5:
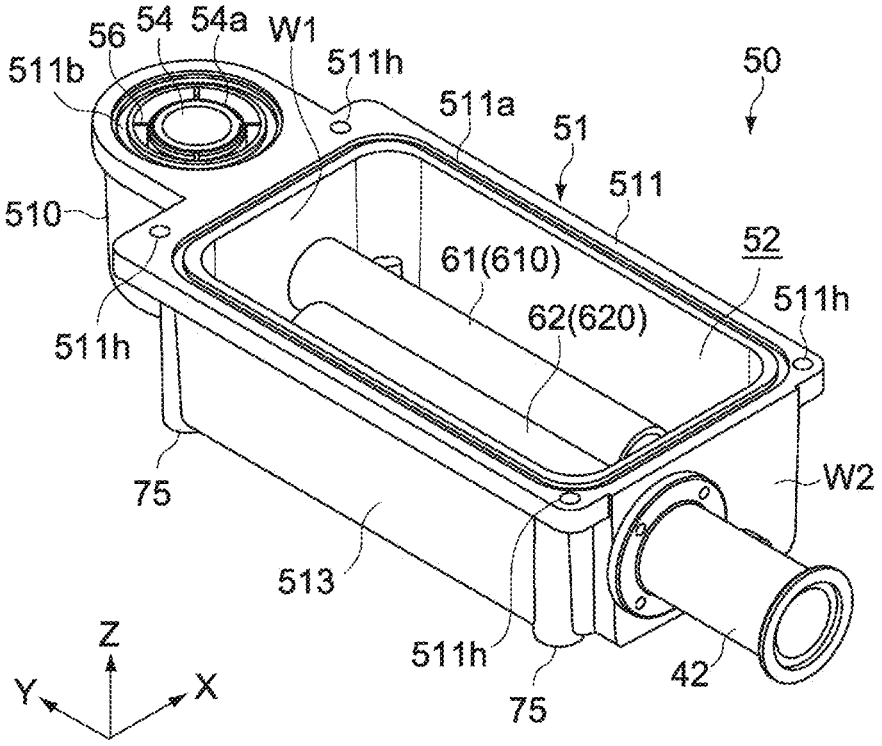
FIG. 5 A perspective view of a sound muffling device in the vacuum pump.
Figure 6:
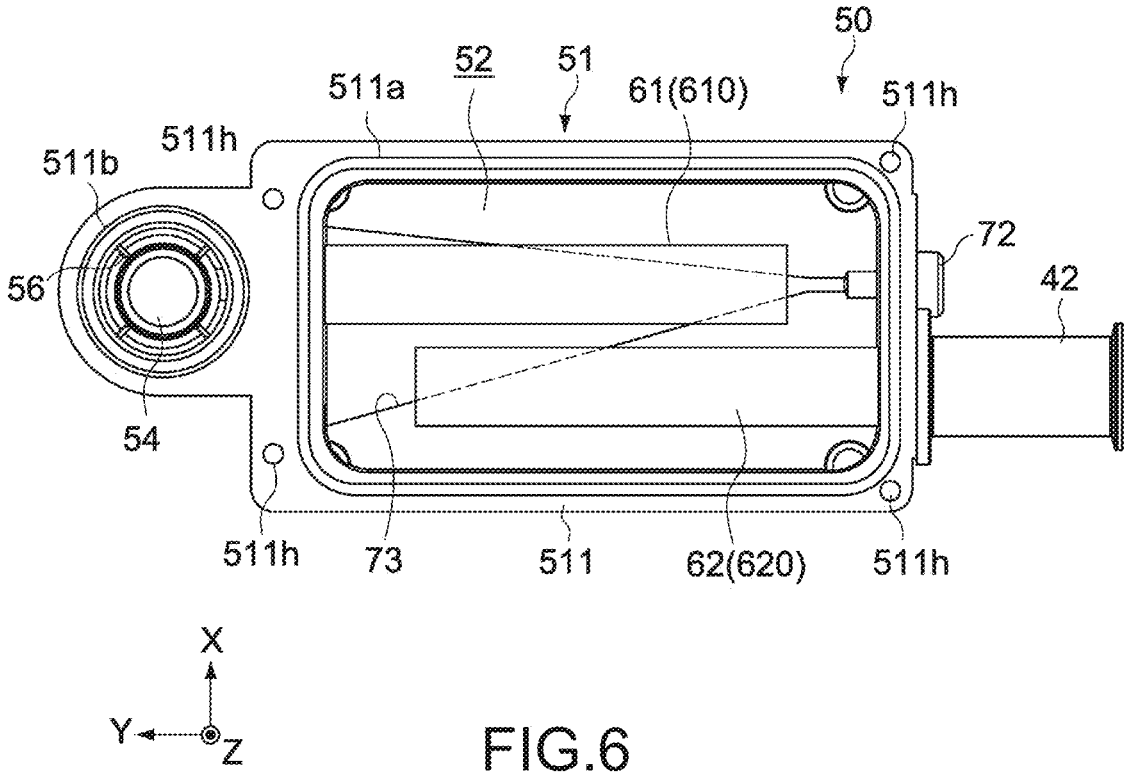
FIG. 6 A plan view of the sound muffling device.
Figure 7:
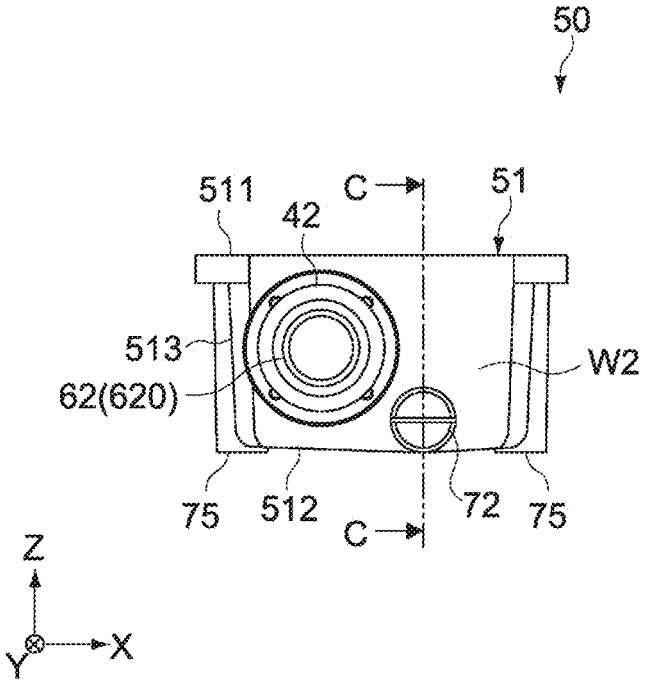
FIG. 7 A rear view of the sound muffling device.
Figure 8:
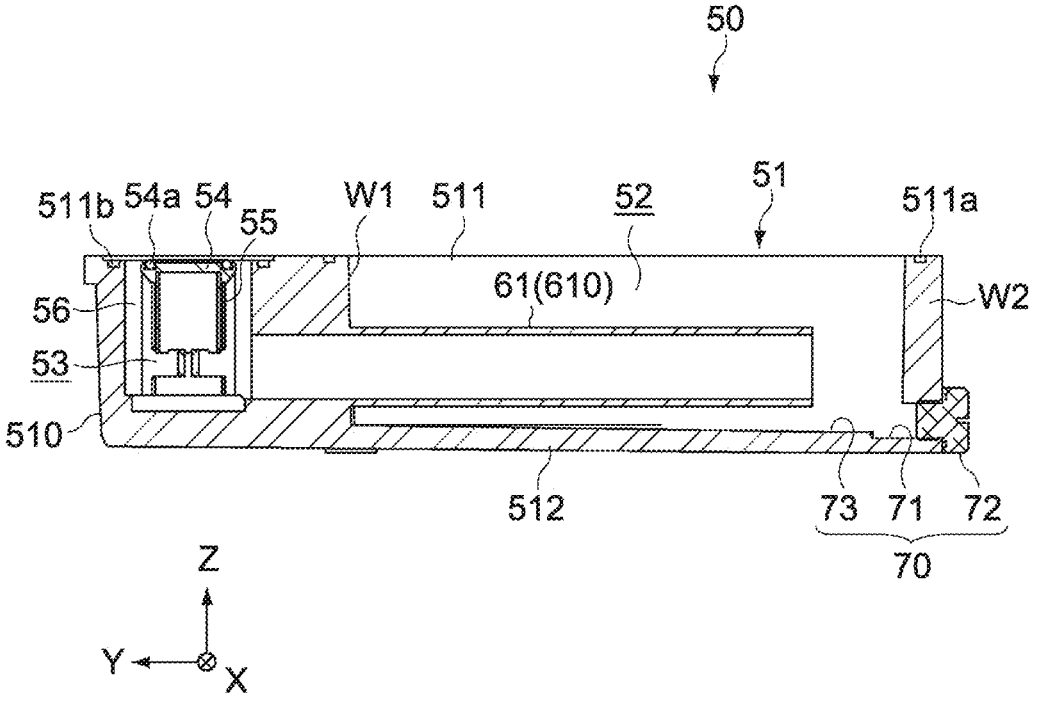
FIG. 8 A cross-sectional view taken along the line C-C of FIG. 7.

FIG. 5 is a perspective view of the sound muffling device 50. FIG. 6 is a plan view thereof. FIG. 7 is a rear view thereof. FIG. 8 is a cross-sectional view taken along the line C-C of FIG. 7.

The sound muffling device 50 includes a casing 51, a first passage portion 61, and a second passage portion 62.

The casing 51 is constituted by a metal box having a substantially rectangular parallelepiped shape including a longitudinal direction in the Y-axis direction. The casing 51 includes an opening end portion 511, a bottom wall portion 512, and a peripheral wall portion 513.

The opening end portion 511 is constituted by a flange portion. The flange portion is formed at an upper end portion of the casing 51 and is parallel to the XY-plane. The opening end portion 511 includes an annular groove 511*a* on which a seal ring S1 (see FIG. 3) is mounted and a plurality of bolt insertion holes 511*h*. The annular groove 511*a* is formed in an upper surface of the opening end portion 511. The bolt insertion holes 511*h* are provided at four corners of the opening end portion 511.

The bottom wall portion 512 faces the opening end portion 511 in a Z-axis direction and constitutes the bottom portion of the casing 51. The peripheral wall portion 513 is provided between the opening end portion 511 and the bottom wall portion 512. The peripheral wall portion 513 is formed upright from a circumferential portion of the bottom wall portion 512. The peripheral wall portion 513 is constituted by four side wall portions including first and second side wall portions W1 and W2. The first and second side wall portions W1 and W2 face each other in the Y-axis direction.

The casing 51 is airtightly connected to an outer wall surface 20*w* of the bottom portion of the pump main body 10. In this manner, an expansion chamber 52 is defined between the outer wall surface 20*w* and an inner wall surface of each of the bottom wall portion 512 and the peripheral wall portion 513. The outer wall surface 20*w* which is held in contact with the opening end portion 511 of the casing 51 is constituted by a flat surface (see FIGS. 3 and 4). The outer wall surface 20*w* is connected to the casing 51 via the seal ring S1 and a plurality of bolts B1. The outer wall surface 20*w* that faces the expansion chamber 52 includes a plurality of ribs 20*w*1 (see FIG. 3) and each of recess portions 20*w*2 including a pair of tilted surfaces tilted toward an area between shafts of the first and second screw rotors 11 and 12.

The casing 51 further includes an auxiliary wall portion 510 that defines a valve chamber 53. The auxiliary wall portion 510 has a substantially partial cylindrical shape having a bottom, whose upper surface is opened. The auxiliary wall portion 510 is provided to be continuous with a first side wall portion W1. The upper surface of the auxiliary wall portion 510 is constituted by a flat surface belonging to a plane identical to that of the upper surface of the opening end portion 511. The upper surface of the auxiliary wall portion 510 includes an annular groove 511*b* on which a seal ring (not shown) which is in elastic contact with the periphery of the exhaust port 23 is mounted. The auxiliary wall portion 510 is airtightly connected to the periphery of the exhaust port 23 in such a manner that the casing 51 is connected to the outer wall surface 20*w* of the pump main body 10.

The valve chamber 53 is adjacent to the expansion chamber 52 while the first side wall portion W1 is sandwiched therebetween in the longitudinal direction (Y-axis direction) of the casing 51. The valve chamber 53 is provided between the exhaust port 23 and the expansion chamber 52 and houses a valve member 54. The valve member 54 is configured as a check valve that opens and closes the exhaust port 23. The valve member 54 is urged in a direction to close the exhaust port 23 with spring force of a valve spring 55 including one end engaged with a bottom portion of the valve chamber 53. The valve member 54 is seated on a circumferential portion of the exhaust port 23 via a valve seal 54*a* to prevent inhibit counter flow of gas from the valve chamber 53 to the exhaust port 23. The spring force of the valve spring 55 is not particularly limited. Typically, the spring force of the valve spring 55 is set at a level that enables the valve member 54 to be opened when the internal pressure of the exhaust port 23 exceeds the atmospheric pressure.

The valve chamber 53 further includes a guide mechanism that guides movement of the valve member 54 in an upper and lower direction (Z-axis direction). In this embodiment, as shown in FIGS. 5 and 6, the guide mechanism is constituted by a plurality of (in this example, four) guide pieces 56 arranged to be slidable in the periphery of the valve member 54. Each of the guide pieces 56 is fixed on the valve chamber 53 to protrude toward a peripheral surface of the valve member 54 from an inner wall surface of the valve chamber 53.

The first passage portion 61 penetrates the first side wall portion W1. The first passage portion 61 is configured to be capable of introducing gas discharged through the exhaust port 23 from the valve chamber 53 to the expansion chamber 52. In this embodiment, the first passage portion 61 is constituted by a pipe member 610 (first pipe member). The pipe member 610 extends in the Y-axis direction from the first side wall portion W1 toward the inside of the expansion chamber 52. One end of the pipe member 610 is fixed on the first side wall portion W1. The other end of the pipe member 610 is provided in the casing 51 in such a manner that the other end of the pipe member 610 faces a second side wall portion W2, spaced apart from the second side wall portion W2.

On the other hand, the second passage portion 62 penetrates the second side wall portion W2. The second passage portion 62 is configured to be capable of discharging gas in the expansion chamber 52 outside the casing 51. In this embodiment, the second passage portion 62 is constituted by a pipe member 620 (second pipe member). The pipe member 620 extends in the Y-axis direction from the second side wall portion W2 toward the inside of the expansion chamber 52. One end of the pipe member 620 is fixed on the second side wall portion W2. The other end of the pipe member 620 is provided in the casing 51 in such a manner that the other end of the pipe member 620 faces the first side wall portion W1, spaced apart from the first side wall portion W1.

The pipe members 610 and 620 are each constituted by a metal circular pipe having predetermined length and inner diameter. Each of the pipe members 610 and 620 typically has a flow channel cross-sectional area sufficiently smaller than that of the expansion chamber 52. With this configuration, a rapidly enlarged portion and a rapidly reduced portion of the flow channel cross-section are formed in a passage of gas that flows through the sound muffling device 50, and thus the sound muffling effect of exhaust sound in a low frequency band can be improved. It should be noted that the length of each of the pipe members 610 and 620 can be set as appropriate in accordance with a frequency band which is to be attenuated.

The lay-out of the pipe members 610 and 620 is also not particularly limited. In this embodiment, the two pipe members 610 and 620 are arranged at positions at which the respective shaft centers are offset from each other and have regions facing each other in the X-axis direction (see FIG. 6). With this configuration, the capacity in the expansion chamber 52 is secured and thus a sufficient expansion action of gas can be obtained. Moreover, a sufficient length of each passage portion 61 or 62 is secured and thus a further improvement in the sound muffling effect can be achieved.

An exhaust pipe 42 is mounted on an outer surface of the second side wall portion W2. The exhaust pipe 42 communicates with the inside (second passage portion 62) of the pipe member 620. A processing unit (not shown) or the like that detoxifies gas discharged from the sound muffling device 50 may be connected to the exhaust pipe 42.

The casing 51 further includes a water drain portion 70 as shown in FIG. 8. The water drain portion 70 is for discharging liquid (e.g., condensed water or dew condensation water of discharged gas), which is generated in the expansion chamber 52, outside the sound muffling device 50. Therefore, a water drain port 71 includes a drain cover 72 and a guide passage 73.

The water drain port 71 is constituted by a through-hole (screw hole) that provides communication between the expansion chamber 52 and the outside of the casing 51. In this embodiment, the water drain port 71 is provided in a bottom portion of the side wall portion W2. The drain cover 72 is attached to be capable of closing the water drain port 71 outside the side wall portion W2 and is typically constituted by a drain bolt. The guide passage 73 is provided in the inner wall surface of the bottom wall portion 512 and is constituted by a tilted surface tilted toward the above-mentioned water drain port with respect to the XY-plane (see FIG. 8). As shown in FIG. 6, the guide passage 73 is formed of a recess groove having a groove width gradually narrower from the first side wall portion W1 to the second side wall portion W2. With this configuration, discharge water can be efficiently guided to the water drain port 71.

The casing 51 further includes a plurality of leg portions 75 that support the pump main body 10. The plurality of leg portions 75 are constituted by four columns having a substantially cylindrical shape. The four columns each protrude from a lower surface of the flange portion constituting the opening end portion 511 toward outer surfaces of the four corners of the bottom wall portion 512 along the peripheral wall portion 513. End portions of those leg portions 75 are located on an identical plane. The end portions of those leg portions 75 are typically placed on a working table or a floor to thereby horizontally support the vacuum pump 100.

The casing 51 is made of a casting of metal material such as an aluminum alloy. The two pipe members 610 and 620 constituting the first and second passage portions 61 and 62 are casted integrally with the casing 51 by a casting method. The thickness of the bottom wall portion 512 or the peripheral wall portion 513 is not particularly limited. For example, the bottom wall portion 512 or the peripheral wall portion 513 is formed having a thickness of 5 mm or more and 10 mm or less. The valve member 54 and the valve spring 55 are incorporated in the valve chamber 53 inside the auxiliary wall portion 510 after the casing 51 is casted.

[Operation of Vacuum Pump]

In the vacuum pump 100 according to this embodiment, the sound muffling device 50 discharges gas, which is discharged from the exhaust port 23 of the pump main body 10, outside the sound muffling device 50 via the first passage portion 61, the expansion chamber 52, and the second passage portion 62. At this time, the discharged gas inside the sound muffling device 50 passes through a rapidly reduced portion of the flow channel cross-section from the valve chamber 53 to the first passage portion 61 and a rapidly enlarged portion of the flow channel cross-section from the first passage portion 61 to the expansion chamber 52 and passes through a rapidly reduced portion of the flow channel cross-section from the expansion chamber 52 to the second passage portion 62 anew. With this configuration, exhaust sound can be reduced at a predetermined level or less.

In particular, in this embodiment, the casing 51 of the sound muffling device 50 includes the opening end portion 511. The casing 51 is connected to the bottom portion of the outer wall surface 20*w* of the pump main body 10 via the opening end portion 511. Therefore, it is possible to secure the capacity of the expansion chamber 52 and mount the sound muffling device 50 on the pump main body 10 in a compact state. Specifically, an upper wall portion of the sound muffling device 50 can be shared with the outer wall surface 20*w* of the pump main body 10. Therefore, the height of the sound muffling device 50 can be reduced by an amount corresponding to the thickness of the upper wall portion. Thus, in accordance with this embodiment, the sound muffling effect can be secured and downsizing of the vacuum pump 100 can be achieved.

Further, the casing 51 of the sound muffling device 50 constitutes a part of the outer wall surface of the pump main body 10. Therefore, the first housing portion 201 can be strengthened. In addition, the opening end portion 511 of the casing 51 and the outer wall surface 20*w* of the pump main body 10 are each constituted by a flat surface. Therefore, it is easy to secure the airtightness and it is possible to easily assemble them with the plurality of bolts B1 without requiring an additional member.

In addition, the sound muffling device 50 is arranged on the bottom portion of the pump main body 10. Therefore, it is possible to maximally secure the capacity of the expansion chamber 52 and easily discharge condensed water and the like, which are generated in the expansion chamber 52, outside. In this embodiment, the valve member 54 is configured to close the exhaust port 23 from below. Therefore, it is possible to guide condensed water of discharged gas generated in the pump chamber 21 to the expansion chamber 52 (water drain portion 70) without stagnating it in the exhaust port 23 and the valve chamber 53.

In addition, the leg portions 75 that support the vacuum pump 100 can be provided integrally with the casing 51. Therefore, the configuration of the pump main body 10 can be simplified and the number of assembling steps can be reduced because it is unnecessary to additionally assemble the leg portions that support the pump main body 10.

Then, the first and second passage portions 61 and 62 of the sound muffling device 50 are each constituted by the pipe members 610 and 620 protruding into the expansion chamber 52. Therefore, it is possible to efficiently attenuate energy of gas in the expansion chamber 52 and obtain a desired sound muffling effect. Further, it is possible to easily fabricate such a complicated inner structure of the sound muffling device 50 by the casting method. Therefore, the degree of freedom of design is high. It is thus easy to optimize the design in accordance with specifications.

Second Embodiment

Figure 9:
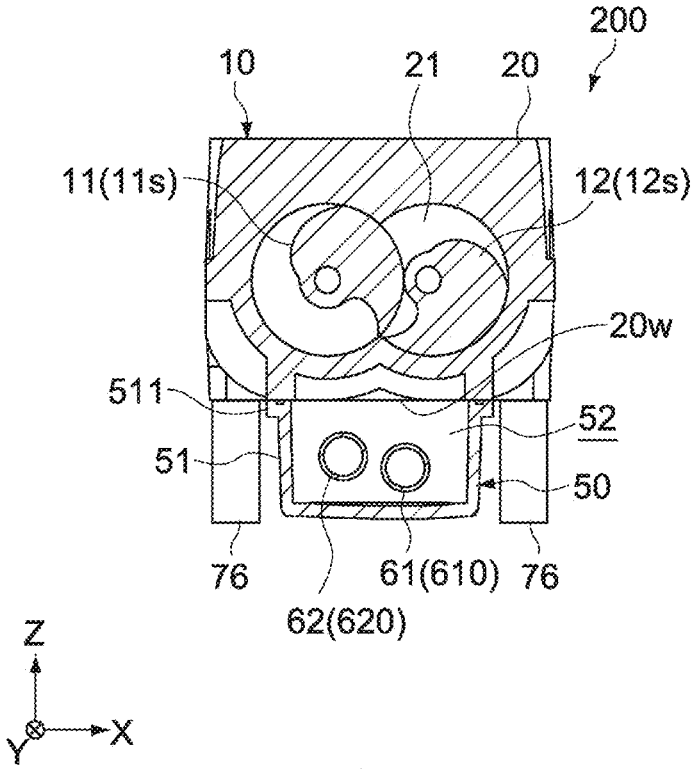
FIG. 9 A cross-sectional view of main parts of a vacuum pump according to a second embodiment of the present invention.

FIG. 9 is a cross-sectional view of main parts showing a configuration of a vacuum pump 200 according to a second embodiment of the present invention. Hereinafter, configurations different from those of the first embodiment will be mainly described, configurations similar to those of the first embodiment will be denoted by similar signs, and descriptions thereof will be omitted or simplified.

The vacuum pump 200 according to this embodiment is different from that of the first embodiment in that a plurality of leg portions 76 that support the pump main body 10 are provided at the bottom portion of the pump main body 10 and the sound muffling device 50 is provided between those plurality of leg portions 76.

The plurality of leg portions 76 are constituted by columns having a substantially columnar shape which protrude from the four corners of the bottom portion of the housing 20 of the pump main body 10 vertically downwards. As in the first embodiment, the sound muffling device 50 includes the casing 51 including the expansion chamber 52 therein and the first and second passage portions 61 and 62 provided in the casing 51. The sound muffling device 50 is airtightly connected to the bottom portion of the outer wall surface 20*w* of the pump main body 10 via the opening end portion 511 of the casing 51.

Also in the vacuum pump 200 according to this embodiment, actions and effects similar to those of the first embodiment can be obtained. In accordance with this embodiment, the region between the plurality of leg portions 76 can be efficiently used. Therefore, space saving of the region in which the sound muffling device 50 is placed can be achieved. The apparatus configuration can be made compact and the vacuum pump 200 having a desired sound muffling effect can be provided.

The plurality of leg portions 76 are not limited to the example in which those are constituted by the cylindrical columns. The plurality of leg portions 76 may be constituted by angle bars or the like provided in the protection casing or the like that houses the pump main body 10 and the pump main body. Further, at least some of the plurality of leg portions 76 may include wheels for movement.

Third Embodiment

Figure 10:
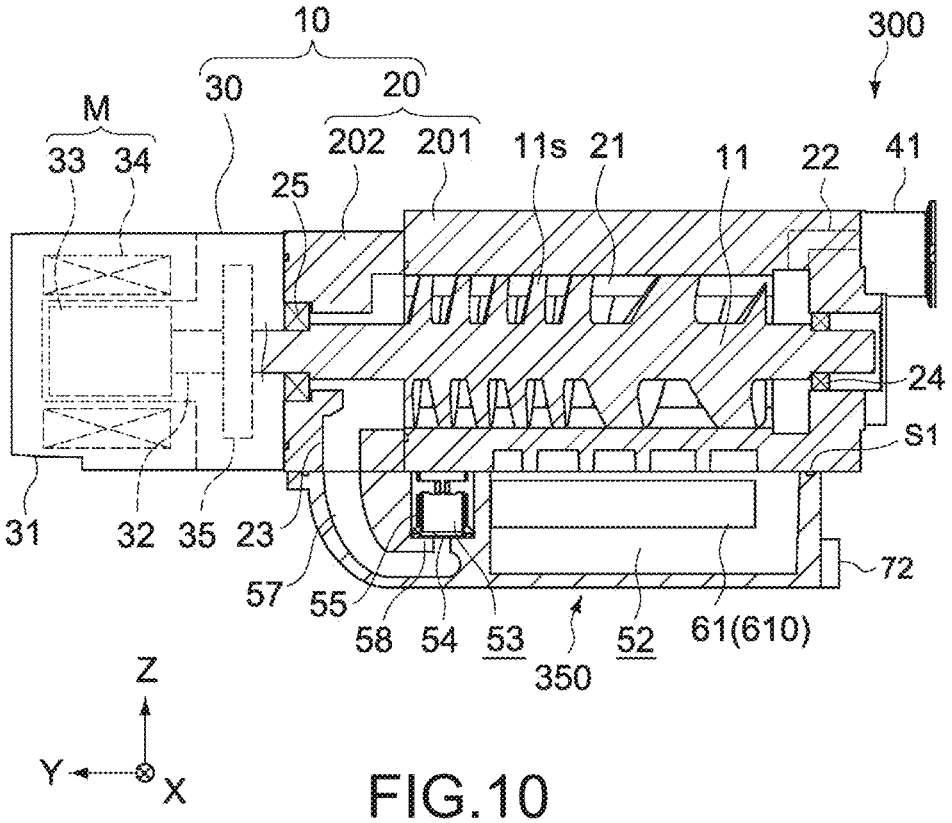
FIG. 10 A schematic cross-sectional view showing a configuration of a vacuum pump according to a third embodiment of the present invention.

FIG. 10 is a schematic cross-sectional view showing a configuration of a vacuum pump 300 according to a third embodiment of the present invention. Hereinafter, configurations different from those of the first embodiment will be mainly described, configurations similar to those of the first embodiment will be denoted by similar signs, and descriptions thereof will be omitted or simplified.

The vacuum pump 300 according to this embodiment is different from the first embodiment in terms of a configuration of a sound muffling device 350. In this embodiment, the sound muffling device 350 includes a connecting passage 57 that causes the exhaust port 23 provided in the second housing portion 202 of the pump main body 10 to communicate with the valve chamber 54. The valve spring 55 urges the valve member 54 toward an annular valve seat 58 formed between the connecting passage 57 and the valve chamber 53. The valve member 54 is configured to open and close the exhaust port 23 that communicates with the connecting passage 57 by being separated from and seated on the valve seat 58.

Also in the thus configured vacuum pump 300 according to this embodiment, actions and effects similar to those of the first embodiment can be obtained. In accordance with this embodiment, the valve member 54 is urged by the valve spring 55 in a direction of gravity. Therefore, the valve member 54 can be stably seated on the valve seat 58 and the sealing property and durability of the valve member 54 can be improved.

Hereinabove, the embodiments of the present invention have been described. The present invention is not limited only to the above-mentioned embodiments and various modifications can be made as a matter of course.

For example, in the above-mentioned embodiments, the description has been made exemplifying the case where the pump main body 10 is constituted by the screw pump, though not limited thereto. The pump main body may be constituted by another dry pump such as a multi-stage roots pump and a scroll pump.

Further, the description has been made exemplifying the case where the casing 50 is made of the casting, though not limited thereto. It may be made of sheet metal or the like. In addition, the expansion chamber 52 of the sound muffling device 50 or 350 may be filled with a sound absorbing material such as sponge and glass wool. With this configuration, exhaust sound in a high frequency band can also be efficiently reduced.

Moreover, in the above-mentioned embodiments, the description has been made exemplifying the case where the sound muffling device 50 or 350 is arranged in the bottom portion of the pump main body 10, though not limited thereto. The sound muffling device may be arranged on the upper surface or lateral portion of the pump main body. The position of the water drain portion of the sound muffling device and the number of water drain portions of the sound muffling device are also not limited to the above examples. For example, in the vacuum pump 300 shown in FIG. 10, the water drain portion may be additionally provided in the connecting passage 57 in addition to the expansion chamber 57.

REFERENCE SIGNS LIST

10 pump main body
11 first screw rotor
12 second screw rotor
20 housing
20*w* outer wall surface
21 rotor chamber
22 intake port
23 exhaust port
30 drive unit
50, 350 sound muffling device
51 casing
52 expansion chamber
53 valve chamber
54 valve member
61 first passage portion
62 second passage portion
70 water drain portion
75, 76 leg portion
100, 200, 300 vacuum pump
511 opening end portion
512 bottom wall portion
513 peripheral wall portion

610, 620 pipe member
W1 first side wall portion
W2 second side wall portion
The invention claimed is:

1. A vacuum pump, comprising:
a pump main body including
a housing including an intake port and an exhaust port, and
a pair of screw rotors that each have a shaft center parallel to one axial direction, are rotatably arranged inside the housing, and transport gas from the intake port to the exhaust port; and
a sound muffling device including
a casing including
an opening end portion that is airtightly connected to an outer wall surface of the housing,
a bottom wall portion that faces the opening end portion, and
a peripheral wall portion, the casing defining an expansion chamber by the outer wall surface of the housing and respective inner wall surfaces of the bottom wall portion and the peripheral wall portion,
a first passage portion that is provided in the casing and introduces gas into the expansion chamber, the gas being discharged from the exhaust port, and
a second passage portion that is provided in the casing and discharges the gas inside the expansion chamber outside the casing, wherein
the sound muffling device further includes
a valve member capable of opening and closing the exhaust port, and
a valve chamber that is provided between the exhaust port and the expansion chamber and houses the valve member,
the peripheral wall portion includes
a first side wall portion that defines the expansion chamber and the valve chamber, and
a second side wall portion that faces the first side wall portion in the one axial direction,
the first passage portion penetrates the first side wall portion and is constituted by a first pipe member extending from the first side wall portion toward an inside of the expansion chamber in the one axial direction,
the second passage portion penetrates the second side wall portion and is constituted by a second pipe member extending from the second side wall portion toward the inside of the expansion chamber in the one axial direction, and
the first and second pipe members have respective shaft centers that are arranged at positions offset from each other and include regions that face each other in an axis direction orthogonal to the one axis direction.

2. The vacuum pump according to claim 1, wherein
the sound muffling device is arranged on a bottom portion of the pump main body, and
the casing further includes a water drain portion including a water drain port.

3. The vacuum pump according to claim 1, wherein
the outer wall surface of the housing includes a plurality of ribs that are provided in a region that faces the expansion chamber.

4. The vacuum pump according to claim 1, wherein
the outer wall surface of the housing includes a recess portion that is provided in a region that faces the expansion chamber and includes a pair of tilted surfaces tilted toward an area between shafts of the pair of screw rotors.

5. The vacuum pump according to claim 2, wherein
the water drain portion further includes a guide passage provided in the bottom wall portion and is tilted toward the water drain port.

6. The vacuum pump according to claim 2, further comprising
a plurality of leg portions that are provided in the bottom portion of the pump main body and support the pump main body, wherein
the sound muffling device is arranged between the plurality of leg portions.

* * * * *